US007730591B2

(12) United States Patent
Saeger et al.

(10) Patent No.: US 7,730,591 B2
(45) Date of Patent: Jun. 8, 2010

(54) APPARATUS ON A FLAT CARD OR ROLLER CARD FOR TEXTILE FIBRES, SUCH AS COTTON, SYNTHETIC FIBRES OR THE LIKE, FOR REMOVING SHORT FIBRES

(75) Inventors: Nicole Saeger, Aachen (DE); Roland Friedrich, Schwalmtal (DE); Gerhard Hensgen, Hamburg (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 664 days.

(21) Appl. No.: 11/701,370

(22) Filed: Feb. 2, 2007

(65) Prior Publication Data

US 2007/0180670 A1 Aug. 9, 2007

(30) Foreign Application Priority Data

Feb. 6, 2006 (DE) ..... 10 2006 005 589

(51) Int. Cl.
*D01G 15/76* (2006.01)

(52) U.S. Cl. ..... 19/109; 19/200

(58) Field of Classification Search ..... 19/98, 19/109, 200

See application file for complete search history.

(56) References Cited

U.S. PATENT DOCUMENTS 4,309,796 A * 1/1982 Garrison et al. ..... 19/98
5,241,726 A * 9/1993 Pezzoli et al. ..... 19/200
5,530,994 A * 7/1996 Loeffler ..... 19/109
6,145,166 A * 11/2000 Waeber et al. ..... 19/109
6,640,391 B2 * 11/2003 Breuer et al. ..... 19/98
6,880,206 B2 * 4/2005 Pferdmenges et al. ..... 19/200

FOREIGN PATENT DOCUMENTS

| | | | |
|---|---|---|---|
| CH | 680 451 | A5 | 8/1992 |
| EP | 0 388 791 | A1 | 9/1990 |
| EP | 0 848 091 | A1 | 6/1998 |
| EP | 1 378 593 | A1 | 1/2004 |
| GB | 0907493 | A | 10/1962 |
| GB | 2 262 108 | A | 6/1993 |
| GB | 2 378 453 | A | 2/2003 |

OTHER PUBLICATIONS

United Kingdom Search Report, Dated May 31, 2007, Issued in GB0702064.7.

German Search Report dated Aug. 17, 2006, issued in German Application No. 10 2006 005 589.6.

* cited by examiner

*Primary Examiner*—Shaun R Hurley
(74) *Attorney, Agent, or Firm*—Venable LLP; Robert Kinberg; Justine A. Gozzi

(57) ABSTRACT

An apparatus on a carding machine has a covering comprising work and cover elements lying opposite the clothing of a high-speed cylinder. There is, in succession, an air exhaust opening for the exit of air and an opening for entry of air, past which openings a flow of fibers and air is passed. To allow improved detachment and elimination of short fibers in a simple manner, the spacing of the covering upstream of the exhaust opening is smaller than the spacing of the covering between air exhaust opening and air inlet opening and an airflow flows against the direction of rotation of the cylinder along the surface of the cylinder and flows with short fibers through the air exhaust opening.

20 Claims, 5 Drawing Sheets

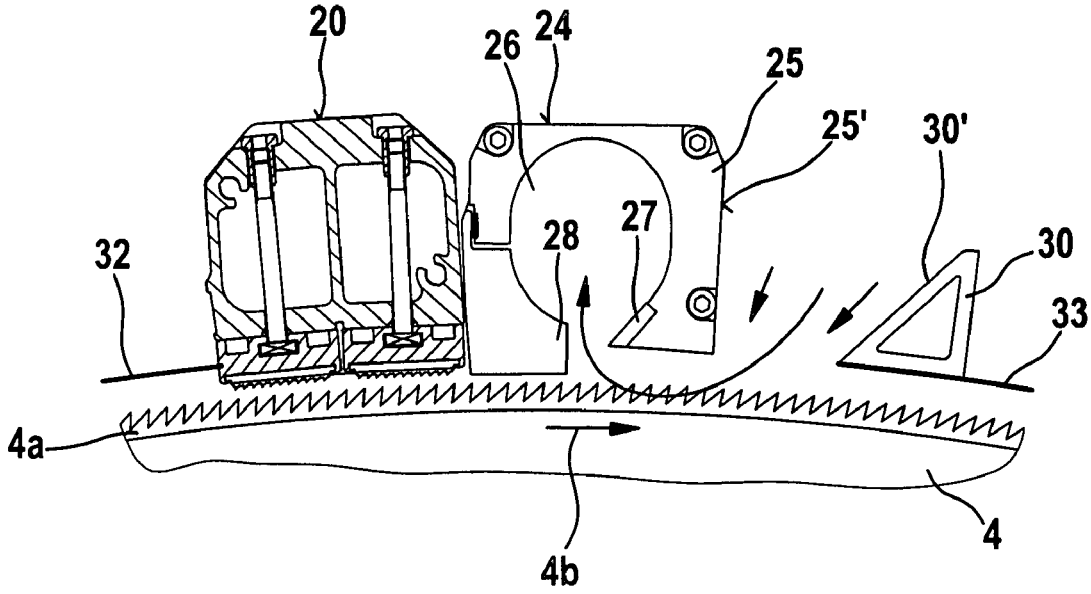
Fig.3a
Fig.3b
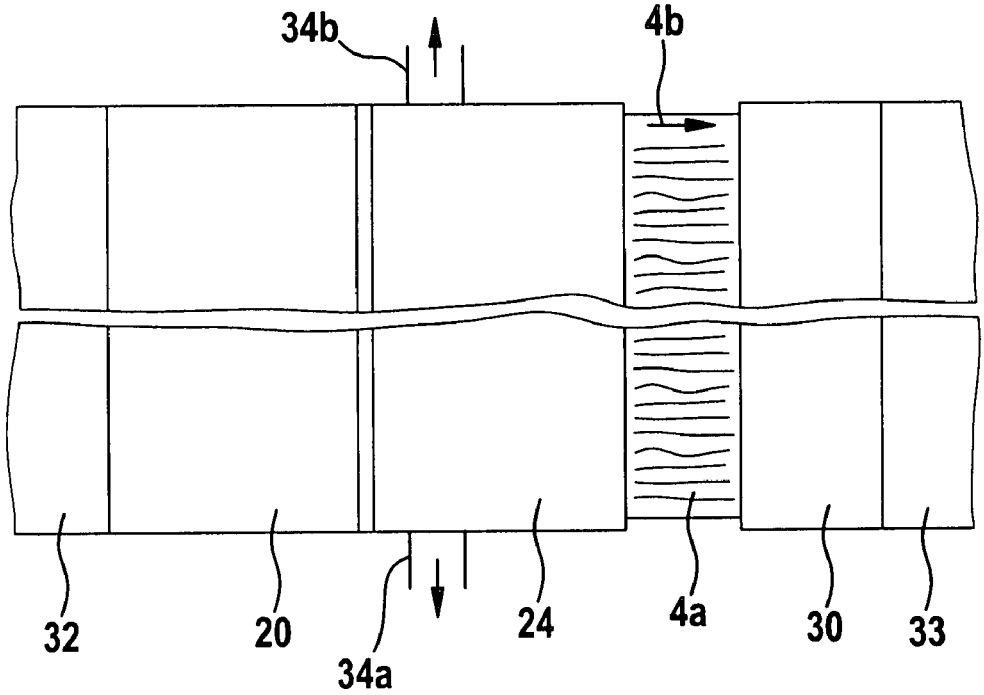

APPARATUS ON A FLAT CARD OR ROLLER CARD FOR TEXTILE FIBRES, SUCH AS COTTON, SYNTHETIC FIBRES OR THE LIKE, FOR REMOVING SHORT FIBRES

CROSS-REFERENCE TO RELATED APPLICATION

The present application claims priority from German Patent Application No. 10 2006 005 589.6 dated Feb. 6, 2006, the entire disclosure of which is incorporated herein by reference.

BACKGROUND OF THE INVENTION

The invention relates to an apparatus on a flat card or roller card for textile fibres such as cotton, synthetic fibres or the like, in which a covering comprising work and cover elements lies opposite the clothing of a high-speed cylinder. In one known apparatus—viewed in the direction of rotation of the cylinder—in succession there is an opening for the exit of air (exhaust airflow) and an opening for entry of air (supply airflow), past which openings a flow of fibres and air is passed, wherein, in relation to the cylinder, the spacing of the covering upstream of the exhaust air opening and the spacing of the covering downstream of the exhaust air opening are different.

In EP 0 848 091 A1, a casing part with a deflector, an exhaust air opening (separation gap), a knife with a separating edge, a guide surface and a supply air opening (air inlet in the form of a slot) lie opposite the clothing of the cylinder, viewed in the direction of rotation. The deflector is arranged upstream of the separation slot and together with the cylinder clothing defines a work slot, through which the flow of fibres and air passes. The separating edge of the knife and the guide surface, which are arranged downstream of the separation gap, have very narrow spacings from the cylinder clothing. The closely set edge determines the proportion of the flow of fibres and air that is separated off by the knife, diverted into the separation gap together with the waste (trash) and consequently removed from the work gap (exhaust airflow). Downstream of the edge, a negative pressure and turbulence therefore develop, and are counterbalanced by the supply airflow. The guide surface downstream of the edge is, like the edge, also set so close to the cylinder that no substantial spread of the airflow after the edge is possible. On the contrary, the introduced air flows off substantially in the transport direction. The drawback is that a considerable portion of such fibres, which are supposed to remain in the processing process, commonly known as good fibres, are separated out together with the trash. What is more, an unacceptable proportion of short fibres remains in the layer of fibres on the cylinder. This leads all in all to unsatisfactory cleaning results, which gives rise to adverse effects in yarn production and to loss of yarn quality.

SUMMARY OF THE INVENTION

It is an aim of the invention to produce an apparatus of the kind described initially, which avoids or mitigates the said disadvantages and which in particular in a simple manner allows improved separation and discharge of short fibres from the fibre layer on the cylinder.

The invention provides an apparatus on a carding machine having a clothed cylinder and a covering arrangement lying opposite the clothing of the cylinder, wherein the covering arrangement comprises one or more work elements and one or more cover elements, and further comprises, arranged in succession in the direction of rotation of the cylinder, an air exhaust opening and an air inlet opening, wherein the spacing between the covering arrangement and the cylinder upstream of the air exit opening is smaller than the spacing between the covering arrangement and the cylinder at a position between the air exhaust opening and the air inlet opening.

The features according to the invention allow a substantially improved separation and discharge of short fibres from the fibre layer on the cylinder. The fibres are present on the cylinder surface opened substantially down to individual fibres. In the arrangement of the invention an air flow can be guided in advantageous manner over the cylinder surface against the direction of rotation of the cylinder and separate the lighter short fibres from the good fibres and discharge them through the exhaust air opening. Because, with regard to the cylinder, the spacing of the covering between the exhaust air opening and the supply air opening is greater than the spacing of the covering upstream of the exhaust air opening, on the one hand there is a greater flow cross-section in the region in which the supply air can flow to the air exhaust opening, and on the other hand the narrow flow cross-section between the covering upstream of the air exhaust opening and the cylinder can form a barrier to the supply air. As a result, the fibre material is thoroughly cleaned of short fibres with high separated amounts and high proportions of short fibres in the waste.

Advantageously, air is sucked against the direction of rotation of the cylinder across the surface of the cylinder into an exhaust arrangement. Preferably, the air is sucked through a flow channel between supply air opening and exhaust air opening. Advantageously, the air is sucked through the clothing of the cylinder. The spacing of the covering upstream of the air exhaust opening may be, for example, about $^{8}/_{1000}$" to $^{15}/_{1000}$", preferably $^{10}/_{1000}$" to $^{14}/_{1000}$". The spacing of the covering from the roller between air exhaust opening and supply air opening may be, for example, about $^{60}/_{1000}$" to $^{100}/_{1000}$". The covering arrangement may comprise various combinations of one or more work elements and one or more cover elements. In one embodiment, the covering arrangement upstream of the air exhaust opening is a holding-down element or the like. The covering upstream of the exhaust air opening may if desired have a separating edge, for example, a separating knife or the like. In addition or instead, the covering upstream of the air exhaust opening may if desired comprise at least one stationary carding element. Where present, the or each stationary carding element may comprise at least one clothing strip, the clothing of the at least one clothing strip and the cylinder clothing preferably being arranged facing one another in the carding position. Where present, the at least one stationary carding element may be arranged closely upstream of the air exhaust opening, for example, directly upstream of the air exhaust opening. In one embodiment, there is a stationary carding element and a holding-down element and the stationary carding element is arranged upstream of the holding-down element. The covering downstream of the air exhaust opening may, in some embodiments, comprise a separating edge, for example, a separating knife. Advantageously, the spacing of the holding down element, where present, and/or of the separating edge, where present, from the cylinder surface is adjustable.

In certain advantageous embodiments, the covering upstream and downstream respectively of the air exhaust opening comprises a guide surface. The spacing of the guide surface from the cylinder surface is preferably adjustable.

Advantageously, a suction device, for example a suction hood, is associated with the air exhaust opening. As well as or instead a blowing arrangement, for example, a compressed air source may be associated with the air inlet opening. The air inlet opening may, if desired, be in connection with the atmosphere. In certain advantageous embodiments, the inside width of the supply air opening and the strength of the exhaust airflow of the suction device are co-ordinated with one another and/or the air exhaust opening and the strength of the exhaust airflow of the suction device are co-ordinated with one another. The inside width of the flow channel between supply air opening and air exhaust opening and the strength of the exhaust airflow of the suction device may, with advantage, be co-ordinated with one another. Where present, the suction device, for example suction hood, has suction applied to it from two sides. A high connection pressure or suction pressure, for example, 1000 Pa or greater per suction side, is preferably present.

One or more apparatus according to the invention may be arranged between doffer and flat assembly, for example, a revolving flat. One or more apparatuses according to the invention may as well or instead be arranged between licker-in and flat assembly, for example, a revolving flat. Preferably, more than one said apparatus is associated with the cylinder. The apparatus may be in the form of a modular arrangement, permitting the entire apparatus, or individual parts thereof, to be interchangeable. In the case of a modular arrangement of the work and/or cover elements, the apparatus may comprise at least one module, for example, it may comprise two modules.

In one embodiment, the apparatus may comprise a deflector that diverts the supply airflow at an acute angle onto the fibre layer on the cylinder, the deflector being associated with the opening for the entry of air. It may be advantageous for the covering arrangement, downstream of the supply air opening, to comprise at least one stationary carding element.

The invention also provides an apparatus on a flat card or roller card for textile fibres such as cotton, synthetic fibres or the like, in which a covering comprising work and cover elements lies opposite the clothing of a high-speed cylinder, in which, viewed in the direction of rotation of the cylinder, in succession there is an opening for the exit of air (exhaust airflow) and an opening for entry of air (supply airflow), past which openings a flow of fibres and air is passed, wherein, in relation to the cylinder, the spacing of the covering upstream of the air exhaust opening and the spacing of the covering downstream of the air exhaust opening are different, wherein in relation to the cylinder the spacing of the covering upstream of the air exhaust opening is smaller than the spacing of the covering between air exhaust opening and supply air opening and an air flow that detaches short fibres from the flow of fibres flows along the surface of the cylinder against the direction of rotation of the cylinder and flows away with the short fibres through the exhaust air opening.

BRIEF DESCRIPTION OF THE DRAWINGS

FIG. 3*a* is a side view of a second embodiment of the apparatus according to the invention with nozzle-like supply air opening and entry of the supply air, passage through the flow channel and the fibre layer and exit of the exhaust air, FIG. 3*b* is a plan view of the apparatus in FIG. 3*a*.

DETAILED DESCRIPTION OF PREFERRED EMBODIMENTS

Figure 1:
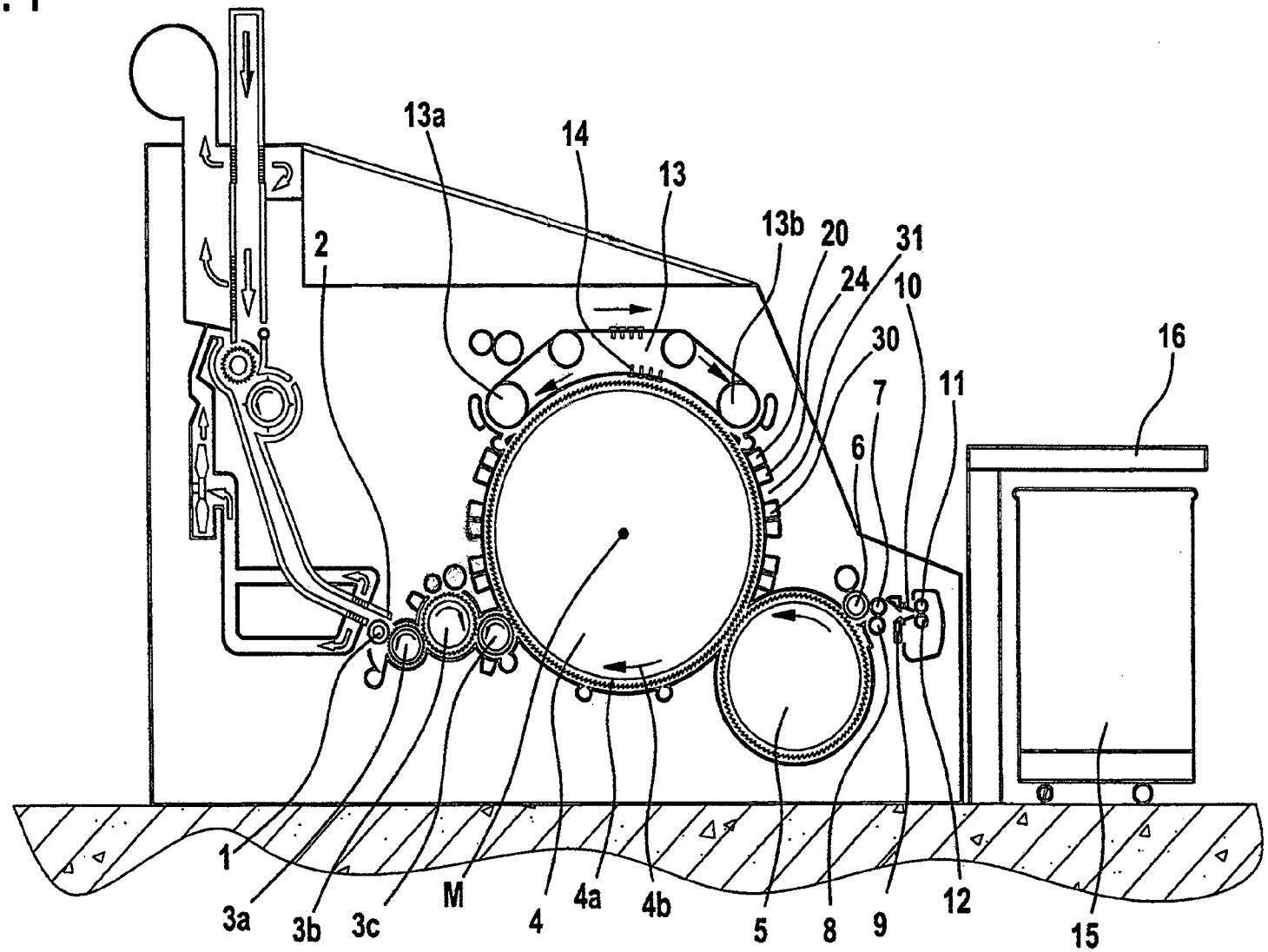
FIG. 1 is a schematic side view of a flat card having an apparatus according to the invention.

With reference to FIG. 1, a flat card, for example, a flat card TC 03 (Trade Mark) made by Trützschler GmbH & Co. KG. of Mönchengladbach, Germany has feed roller 1, feed table 2, licker-ins 3*a*, 3*b*, 3*c*, cylinder 4, doffer 5, stripping roller 6, squeezing rollers 7, 8, web-deflector 9, web funnel 10, take-off rollers 11, 12, revolving flat 13 with flat guide rollers 13*a*, 13*b* and flat bars 14, can 15 and can coiler 16. The directions of rotation of the rollers are shown by respective curved arrows. The letter M denotes the midpoint (axis) of the cylinder 4. The reference numeral 4*a* denotes the clothing and 4*b* denotes the direction of rotation of the cylinder 4. The arrow A denotes the working direction. The curved arrows drawn in the rollers denote the directions of rotation of the rollers. The cylinder 4 has a surface speed, for example, of 35 m/sec.

Figure 2:
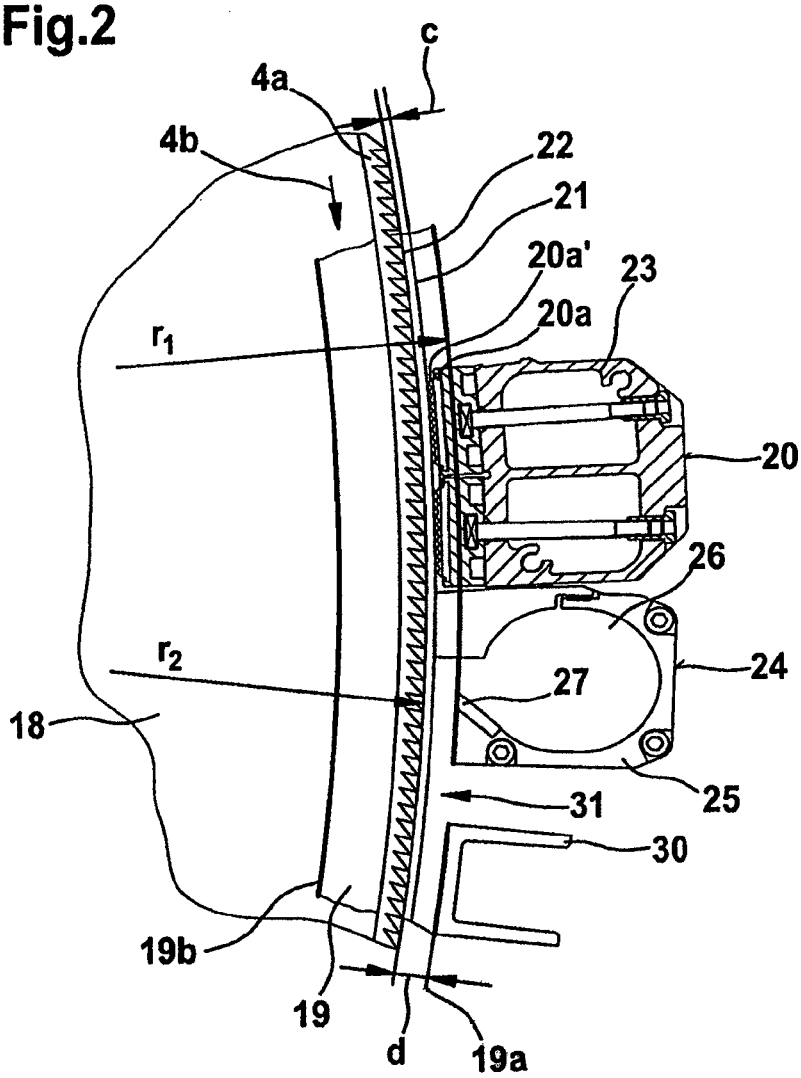
FIG. 2 is a side view of one embodiment of the apparatus of the invention, having, in succession viewed in the direction of rotation of the cylinder, a carding segment, a suction hood with exhaust air opening, a supply air opening and a cover element.
Figure 2A:
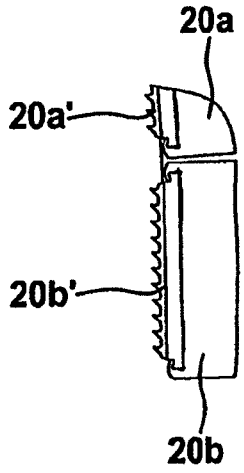
FIG. 2*a* shows in detail the carding elements of the embodiment of FIG. 2.

FIG. 2 shows a first embodiment of the invention, suitable for use in, for example, the card of FIG. 1. On each side of the card an approximately semi-circular, rigid side plate 18 is secured laterally to the machine frame (not shown); cast concentrically onto its outer side in the region of the periphery thereof there is a curved, rigid bearing element 19, which has a convex outer surface 19*a* as its support surface and an underside 19*b*. The apparatus according to the invention comprises an exhaust chamber 24 (suction hood) comprising a hollow profiled element 25, for example, of extruded aluminum, which extends across the width of the cylinder 4 (see FIG. 3*b*). The exhaust chamber 24 has in its interior a hollow space 26, through which air is able to flow. A cylinder cover element 30, for example, of extruded aluminum and approximately U-shaped in cross-section is positioned downstream of the exhaust chamber 24, viewed in the direction of rotation 4*b* of the cylinder. An open gap forming the supply air opening 31 is left clear between the exhaust chamber 24 and the cover element 30. A stationary carding element 20 that at both ends has bearing surfaces that lie on the convex outer surface 19*a* of the bearing element (for example, an extension bend) is positioned upstream of the exhaust chamber 24—viewed against the direction of rotation 4*b* of the cylinder 4. As depicted in FIG. 2 and 2*a*, carding elements 20*a*, 20*b* with clothing strips 20*a'*, 20*b'* (carding clothings) are mounted on the undersurface of the stationary carding element 20. The reference number 21 denotes the tip circle of the clothings 20*a'*, 20*b'*. The cylinder 4 has on its periphery a cylinder clothing 4*a*, for example a saw tooth clothing. The reference numeral 22 denotes the tip circle of the cylinder clothing 4*a*. The distance between the tip circle 21 and the tip circle 22 is denoted by the letter c, and is, for example, 0.20 mm. The spacing between the convex outer surface 19*a* and the tip circle 22 is denoted by the letter d. The radius of the convex outer surface 19*a* is denoted by $r_1$ and the radius of the tip circle 22 is denoted by $r_2$. The radii $r_1$ and $r_2$ intersect at the mid-point M of the cylinder 4. The carding segment 20 shown in FIG. 2 consists of a support and two carding elements 20*a*, 20*b*, which are arranged in succession in the direction of rotation (arrow 4*b*) of the cylinder 4, the clothings 20*a'*, 20*b'* of the carding elements 20*a*, 20*b* and the clothing 4*a* of the cylinder 4 lying opposite each other. The carrier body 23 consists of an aluminum hollow profiled member and has continuous hollow spaces.

In the embodiment of FIG. 3, a cylinder cover plate 32, a stationary carding element 20, a suction hood 24, a supply air opening 31, a cover element 30 and a cylinder cover plate 33 are arranged in succession—viewed in the direction of rotation 4*b* of the cylinder 4—and opposite the cylinder clothing 4*a*. In the region of an open edge of the suction hood 24 facing towards the cylinder 4, a knife blade 27 is secured, for example, by screws, to the suction chamber 24. A profiled cover 28 is attached in the region of the other open edge facing towards the cylinder 4. Opposite the separation edge of the knife blade 27, the profiled cover 28 leaves open a gap, the exhaust air opening 29, through which the exhaust airflow with the short fibres enters the interior 26 of the hollow profiled member 24 and is extracted from there (see FIG. 3*b*). The cover element 30 is approximately triangular in cross-section, the face 30, being arranged at an acute angle to the tangent to the tip circle 22. Together with the perpendicular face 25' opposite, the face 30' forms a deflector, converging for instance in the manner of a nozzle, for the supply airflow, which enters and passes through the supply air opening 31.

Referring to FIG. 3*b*, attached to each end of the suction chamber 24 is a suction line 34*a*, 34*b* respectively, which leads to a source of suction air (not shown). The letter 1 denotes the length of the elements 32, 20, 24, 30 and 33, which extend across the width of the machine, or rather the cylinder 4. The cylinder 4 has a width, for example, of 1 m.

Figure 4:
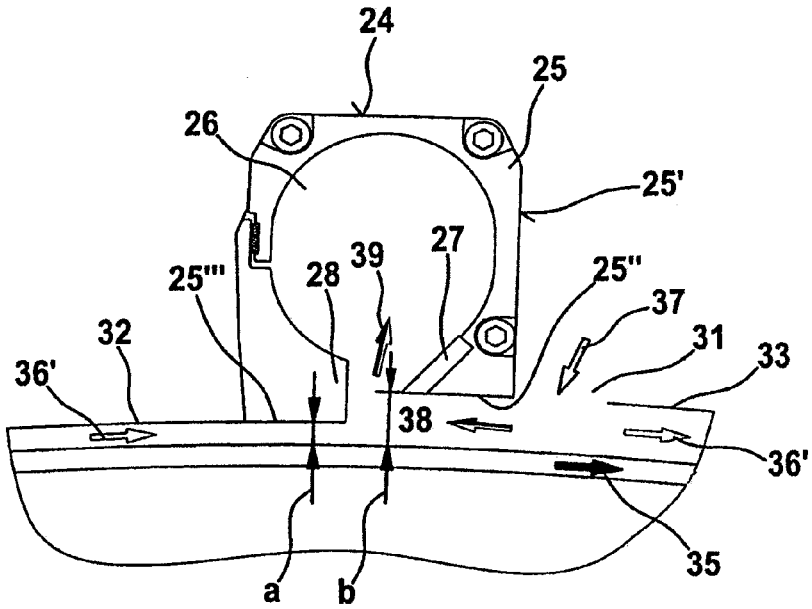
FIG. 4 is a schematic side view of a third embodiment of the apparatus according to the invention with spacings between the cylinder clothing and covering upstream and downstream of the exhaust air opening as well as flow directions of the supply airflow, the exhaust airflow, the airflow around the cylinder, and of the fibre layer on the cylinder.

In the embodiment of FIG. 4, the fibre layer 35, indicated schematically by a filled arrow, which indicates the direction of rotation or movement of the fibre layer 35, is located in the clothing 4*a* of the cylinder 4 (see FIGS. 2 and 3*a*). An airflow 36' indicated schematically by an unfilled arrow that indicates the direction of rotation and movement of the airflow 36' is entrained by the cylinder 4 between the covering (cover plate 32, guide surfaces 25''' and 25'' of the suction hood 24, cover plate 33 and of course the other elements illustrated in FIG. 3*a*, for example, the stationary carding element 20 and cover element 30), and the clothing 4*a* of the cylinder 4. The supply airflow 37, indicated by an unfilled arrow, passes from the atmosphere through the supply air opening 31 between the suction hood 24 and the cover plate 33. The supply airflow 37 flows through a flow channel 38, which is formed between a lower guide surface $\mathbf{25}^{II}$ of the hollow profiled member 25 on the one hand and the clothing 4*a* of the cylinder 4 on the other hand, and subsequently, in the form of the exhaust airflow 39, indicated by a half-filled arrow, enters through the exhaust air opening 29 into the interior of the suction hood 24 and is extracted from there. In relation to the cylinder 4 or rather the tip circle 22 of the cylinder clothing 4*a*, the spacing a of the covering (guide surface 25''') upstream of the exhaust air opening 29 is less than the spacing b of the covering (guide surface 25') between exhaust air opening 29 and supply air opening 31. In this way, the supply airflow 37 flows through the relatively wide flow channel 38 against the airflow 36' around the cylinder 4 and against the fibre layer 35 in the clothing 4*a*, in the process entrains unwanted short fibres and flows away as exhaust airflow 39 together with the short fibres through the exhaust air opening 29. The profiled cover 28 and the relatively narrow channel between the guide surface 25''' and the clothing, the spacing of which is denoted by the letter a, form a barrier to the supply airflow, so that it is constrained to flow into the exhaust air opening. The exhaust gap 29 is wide, for example, about 8 mm.

Figure 5:
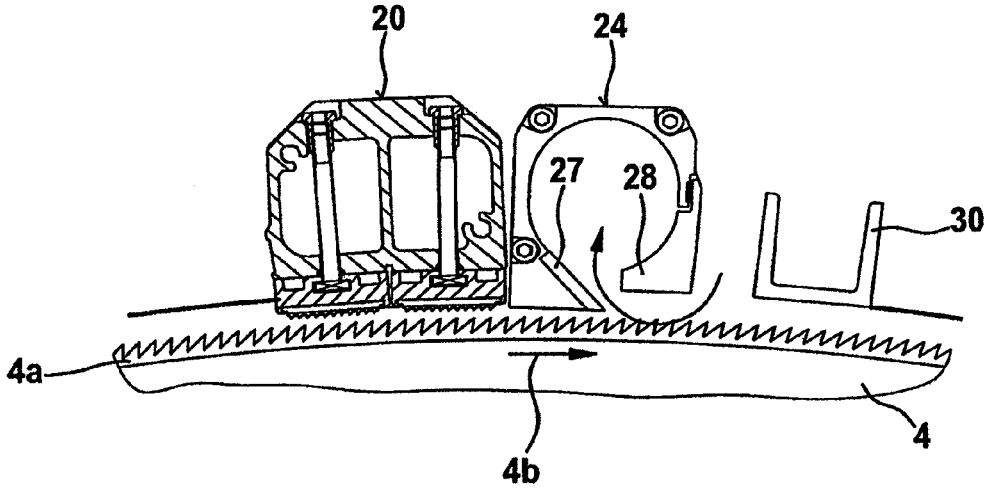
FIG. 5 is a side view of a fourth embodiment of the invention.

FIG. 5 shows a further embodiment, in which—viewed in the direction of rotation 4*b* of the cylinder—a knife $\mathbf{27}_1$ is arranged upstream of the exhaust opening 29 and a profiled cover $\mathbf{28}_1$ is arranged downstream of the exhaust opening 29. The exhaust gap is narrow, for example, about 1.5 mm.

Figure 6:
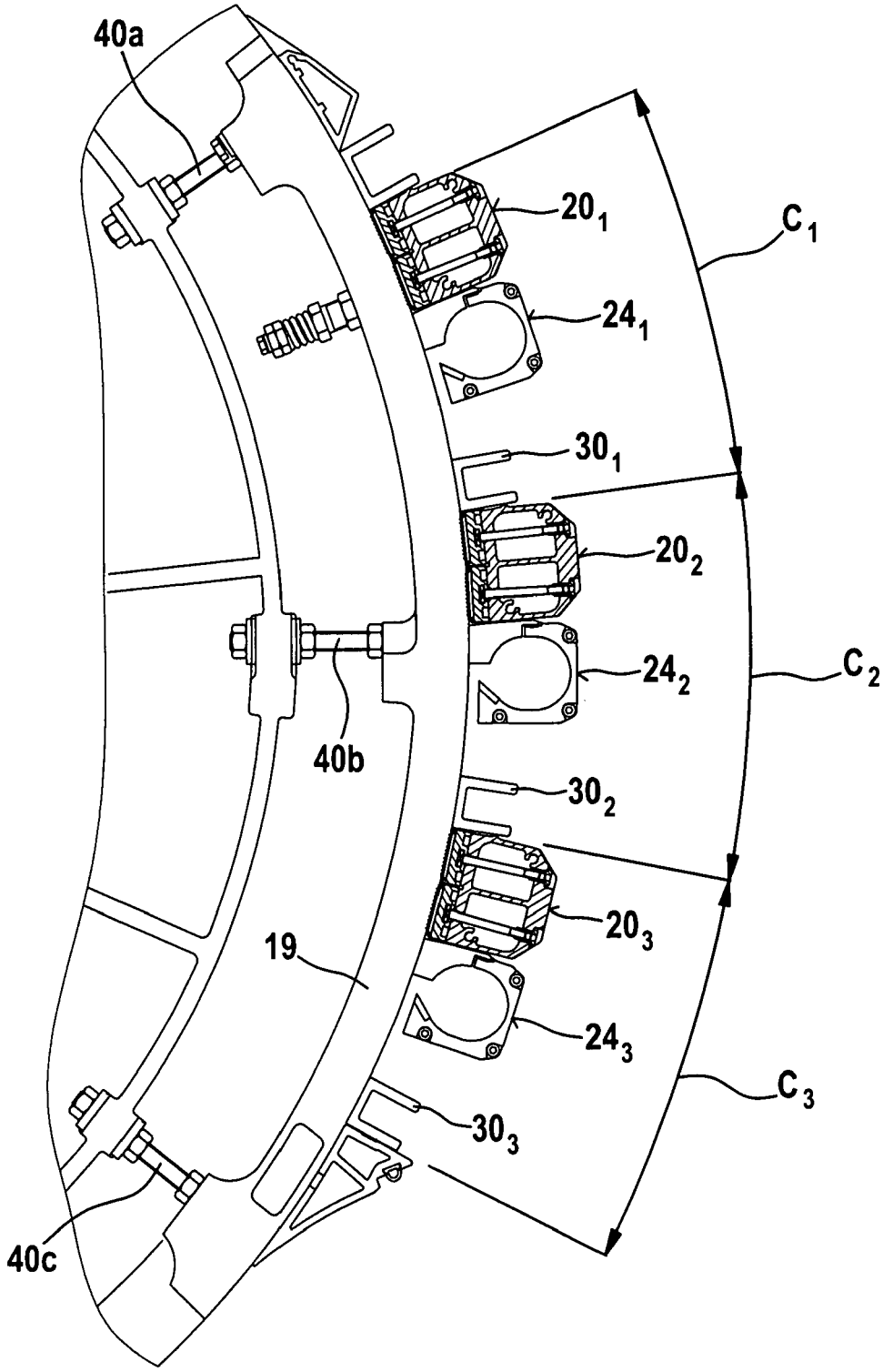
FIG. 6 is a side view of a part of a carding cylinder at which is provided a sixth embodiment of the invention with three modules for separation of short fibres in the post-carding zone.

In FIG. 6 there are present in the post-carding zone, three modules $C_1$, $C_2$, $C_3$ according to the invention which serve for separation of short fibres. The positions indicated with numerals are occupied with the elements 20.sub.1, 20.sub.2, 20.sub.3, $\mathbf{24}_1$, $\mathbf{24}_2$, $\mathbf{24}_3$, and $\mathbf{30}_1$, $\mathbf{30}_2$, $\mathbf{30}_3$. The elements 20 and 24 take up the full width and the elements 30 take up about half the width of a module. The modules $C_1$, $C_2$, $C_3$ are arranged on the extension bend 19 of the flat card. The extension bend 19 is adjustable via adjusting spindles 40*a*, 40*b*, 40*c*.

It can be practical for the covering to include at least one stationary carding element (not shown) after the or each supply air opening (31). In this way, the fibre layer on the cylinder, which can be raised up locally as a result of the supply airflow 37 meeting the airflow 36' entrained by the cylinder 4, is smoothed down.

In the case of the short fibre separation element, use is made of a hood to which suction is applied and which is adjusted specifically with respect to the surface, in combination with a carding element located directly upstream of the hood and in combination with an opening following the hood for intake of the exhaust air. The short fibres are extracted by suction from the total fibre flow. In the process, air is sucked against the direction of rotation of the cylinder over the cylinder surface into a suction hood. The required inflow and extraction situation and the flow and pressure circumstances existing at the hood, which exert a critical influence on the quality of separation, are achieved, inter alia, by:

The spacing of the hood elements (for example, holding-down elements and knives) from the cylinder. A crucial factor here is that in the incoming flow region there is a large opening gap (for example, $^{80}/_{1000}$" between cylinder and hood element, in this instance a knife). Furthermore, the other hood element, which the fibre flow reaches initially, has a narrow spacing from the cylinder (for example, $^{12}/_{1000}$", in this instance a holding-down element).

An opening following the hood for intake of the exhaust air by suction. This opening can be, for example, 40 mm (in the case of a halved profiled cover element) or less, provided that a satisfactory intake flow can be ensured.

The mounting position upstream of the hood. Advantageously, at least one carding element is adapted directly upstream of the hood. This element can be constructed either with two clothing strips or with one strip directly upstream of the hood.

The position of the clothing strips or clothing strip in the carding element. In the carding position this must face towards the surface lying opposite.

A high connection pressure or exhaust pressure at the hood (for example, extraction suction on both sides with $\geqq$1000 Pa per exhaust side).

The fact that the geometry of the hood (for example, the arrangement of the knives and holding-down elements and the size of the opening gap of the two hood elements knives and holding-down elements relative to one another) exerts an influence on the separation, but different geometries that give the same quality of separation can be implemented.

The fact that by coupling or arranging in succession several hoods results in an increase in the amount of separated short fibres.

The fact that the separation unit is designed so that it can be attached in a duplicated distribution, so that, for example, three separation units can be adapted on the doffer side.

The fact that high short fibre contents greater than 40% are achieved in the waste, with high waste amounts of up to 3% at a hood (a standard MTT hood mounted at an identical cylinder position achieves a waste amount of about 0.2%).

The fact that the short fibre content, irrespective of waste amount, remains at a constant level (otherwise as the waste amount increases the short fibre content drops).

Although the foregoing invention has been described in detail by way of illustration and example for purposes of understanding, it will be obvious that changes and modifications may be practised within the scope of the appended claims.

What is claimed is:

1. An apparatus on a carding machine, comprising:

a clothed cylinder having a direction of rotation; and a covering arrangement lying opposite clothing of the cylinder, wherein the covering arrangement comprises at least one work element and at least one cover element, the covering arrangement defining an air exhaust opening and an air inlet opening, the air exhaust opening being arranged upstream of the air inlet opening in the direction of rotation, wherein a spacing between the covering arrangement and the cylinder at a first position upstream of the air exhaust opening is smaller than a spacing between the covering arrangement and the cylinder at a second position between the air exhaust opening and the air inlet opening.

2. The apparatus according to claim 1, wherein the cylinder includes a surface such that an air flow is able to flow along the surface in a direction opposite to the direction of rotation of the cylinder and to detach fibres from fiber material transported on the cylinder, and wherein the air flow exits through the air exhaust opening.

3. The apparatus according to claim 2, wherein the air exhaust opening is able to receive short fibers detached and carried by the air flow from the fibre material on the cylinder surface.

4. The apparatus according to claim 1, wherein the spacing between the covering arrangement and the cylinder between the air exhaust opening and the air inlet opening at the second position forms a flow channel along which sucks air.

5. The apparatus according to claim 4, wherein air is sucked through the clothing of the cylinder.

6. The apparatus according to claim 1, wherein the spacing from the cylinder of the covering upstream of the air exhaust opening at the first position is approximately between $^{8}/_{1000}$ inch to $^{15}/_{1000}$ inch and the spacing from the cylinder of the covering between air exhaust opening and air inlet opening at the second position is approximately between $^{60}/_{1000}$ inch to $^{100}/_{1000}$ inch.

7. The apparatus according to claim 1, wherein the covering arrangement includes a separating element arranged upstream of and adjacent to the air exhaust opening, wherein a spacing of the separating element from a cylinder surface is adjustable.

8. The apparatus according to claim 1, wherein the covering arrangement includes at least one stationary carding element arrange upstream of the air exhaust opening and/or downstream of the air inlet opening.

9. The apparatus according to claim 8, further comprising at least one stationary carding element arranged closely upstream of the air exhaust opening.

10. The apparatus according to claim 1, wherein the covering arrangement includes a separating element arranged downstream the air exhaust opening, wherein the spacing of the separating element from the cylinder being adjustable.

11. The apparatus according to claim 1, wherein the covering arrangement upstream and downstream respectively of the air exhaust opening comprises a guide surface, wherein a spacing of the guide surface from the cylinder surface is adjustable.

12. The apparatus according to claim 11, wherein at least a suction device is associated with the air exhaust opening or a blowing arrangement is associated with the air inlet opening.

13. The apparatus according to claim 1, wherein an inside width of the air inlet opening and a strength of an exhaust airflow of a suction device associated with the air exhaust opening are coordinated with one another.

14. The apparatus according to claim 1, further including a suction device associated with the air exhaust opening, wherein dimensions and a configuration of the air exhaust opening and a strength of exhaust airflow of the suction device are coordinated with one another.

15. The apparatus according to claim 1, wherein an internal width of a flow channel between the air inlet opening and the air exhaust opening is substantially matchable with a strength of exhaust airflow of a suction device associated with the air exhaust opening.

16. The apparatus according to claim 1, further comprising a suction device in communication with the air exhaust opening, wherein the suction device has suction applied to it from two sides at a suction pressure of 1000 Pa or greater per suction.

17. The apparatus according to claim 1, further comprising a deflector associated with the air inlet opening, wherein the deflector diverts the supply airflow at an acute angle onto the fibre material on the cylinder is associated with the air inlet opening.

18. The apparatus according to claim 1, wherein the apparatus is in the form of a modular arrangement.

19. The apparatus according to claim 18, wherein the modular arrangement is of the work and/or cover elements and the apparatus comprises two modules.

20. An apparatus on a flat card or roller card for textile fibres, wherein a covering comprising work and cover elements lies opposite clothing of a high-speed cylinder, in which, viewed in a direction of rotation of the cylinder, in succession there is an opening for the exit of air (exhaust airflow) and an opening for entry of air (supply airflow), past which openings a flow of fibres and air is passed, wherein, in relation to the cylinder, the spacing of the covering upstream of the exhaust air opening and the spacing of the covering downstream of the exhaust air opening are different, wherein in relation to the cylinder the spacing of the covering upstream of the exhaust opening is smaller than the spacing of the covering between exhaust air opening and supply air opening and an air flow that detaches short fibres from the flow of fibres flows along a surface of the cylinder against the direction of rotation of cylinder and flows away with short fibres through the exhaust air opening.

* * * * *